US009920637B2

(12) United States Patent
Snyder

(10) Patent No.: US 9,920,637 B2
(45) Date of Patent: Mar. 20, 2018

(54) GAS TURBINE ENGINE DAMPING DEVICE

(71) Applicant: United Technologies Corporation, Hartford, CT (US)

(72) Inventor: Daniel A. Snyder, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 374 days.

(21) Appl. No.: 14/680,139

(22) Filed: Apr. 7, 2015

(65) Prior Publication Data

US 2016/0298466 A1 Oct. 13, 2016

(51) Int. Cl.

| | |
|---|---|
| ***F01D 5/22*** | (2006.01) |
| ***F01D 11/00*** | (2006.01) |
| ***F01D 25/06*** | (2006.01) |
| ***F01D 5/30*** | (2006.01) |

(52) U.S. Cl.

CPC ..... *F01D 5/22* (2013.01); *F01D 5/3007* (2013.01); *F01D 11/006* (2013.01); *F01D 25/06* (2013.01); *F05D 2220/32* (2013.01); *F05D 2240/80* (2013.01)

(58) Field of Classification Search

CPC ..... F01D 5/22; F01D 11/006; F01D 25/06

See application file for complete search history.

(56) References Cited

U.S. PATENT DOCUMENTS

| | | | | |
|---|---|---|---|---|
| 4,455,122 | A | 6/1984 | Schwarzmann et al. | |
| 5,460,489 | A | 10/1995 | Benjamin et al. | |
| 5,827,047 | A | 10/1998 | Gonsor et al. | |
| 6,171,058 | B1 | 1/2001 | Stec | |
| 6,932,575 | B2 * | 8/2005 | Surace | F01D 5/22 416/193 A |
| 7,121,800 | B2 | 10/2006 | Beattie | |
| 8,011,892 | B2 | 9/2011 | Ramlogan et al. | |
| 8,876,478 | B2 | 11/2014 | Wassynger et al. | |
| 2011/0262274 | A1 | 10/2011 | Boy et al. | |
| 2012/0121424 | A1 | 5/2012 | Wassynger et al. | |
| 2014/0112786 | A1 | 4/2014 | Donnell et al. | |
| 2015/0330227 | A1 * | 11/2015 | Propheter-Hinckley | F01D 5/16 416/106 |

FOREIGN PATENT DOCUMENTS

| | | |
|---|---|---|
| EP | 0851096 | 7/1998 |

OTHER PUBLICATIONS

European Search Report for Application No. 16164198.0 dated Sep. 22, 2016.

* cited by examiner

*Primary Examiner* — Woody Lee, Jr.

*Assistant Examiner* — Brian O Peters

(74) *Attorney, Agent, or Firm* — Carlson, Gakey & Olds, P.C.

(57) ABSTRACT

An exemplary gas turbine engine assembly includes a damping device having a first side and a second side facing away from the first side. The first side is configured to hold a seal when the second side engages an extension from a gas turbine engine component. The first side is further configured to engage the extension when the second side holds the seal.

18 Claims, 8 Drawing Sheets

GAS TURBINE ENGINE DAMPING DEVICE

STATEMENT REGARDING FEDERALLY SPONSORED RESEARCH OR DEVELOPMENT

This invention was made with government support under Contract No. FA8650-09-D-2923-0021 awarded by the United States Air Force. The government has certain rights in this invention.

BACKGROUND

Component assemblies of gas turbine engines, such as blades, can vibrate during operation. Damping devices can be used to damp the vibrations. Damping the vibrations can prevent the vibrations from accelerating fatigue.

The damping devices are positioned between circumferentially adjacent blades within a gas turbine engine. Interfaces between the circumferentially adjacent blades are typically sealed. The damping devices are often near these interfaces.

SUMMARY

A gas turbine engine assembly according to an exemplary aspect of the present disclosure includes, among other things, a damping device having a first side and a second side facing away from the first side. The first side configured to hold a seal when the second side engages an extension from a gas turbine engine component. The first side further configured to engage the extension when the second side holds the seal.

In another example of the foregoing assembly, the first side includes a first recessed area to receive one of the seal or the extension, and the second side includes a second recessed area to receive the other of the seal or the extension.

In another example of any of the foregoing assemblies, the first recessed area extends longitudinally in a first direction, and the second recessed area extends longitudinally in a second direction perpendicular to the first direction.

In another example of any of the foregoing assemblies, the first recessed area has a cross-sectional profile that mimics a cross-sectional profile of the second recessed area.

In another example of any of the foregoing assemblies, the gas turbine engine component is a blade and the extension is first extension from a root of a first blade, and the first recessed area is further configured to engage a second extension from a root of a second blade when the second side engages the seal.

In another example of any of the foregoing assemblies, radially inward movement of the damping device is limited exclusively by the first extension and the second extension.

In another example of any of the foregoing assemblies, the damping device is configured to be positioned circumferentially between a first blade and a second blade.

In another example of any of the foregoing assemblies, the first blade and the second blade are constituents of a turbine blade array.

In another example of any of the foregoing assemblies, the damping device is a cast component.

A gas turbine engine assembly according to yet another exemplary aspect of the present disclosure includes, among other things, a plurality of components circumferentially distributed about an axis, a plurality of seals, and a damping device having a first side and a second side opposite the first side. The first side engages one of the seals. The second side engages a first extension from a first one of the components and further engaging a second extension from a second one of the components. The seal is configured to be reoriented such that the first side engages the first and second extensions, and the second side engages the one of the seals.

In another example of the foregoing assemblies, the components are blades and the first extension extends from a root of one of the blades, and the second extension extends from a root of the second one of the blades.

In another example of any of the foregoing assemblies, the first side includes a first recessed area that receives the one of the seals, and the second side includes a second recessed area that receives both the first extension and the second extension.

In another example of any of the foregoing assemblies, the plurality of components are turbine blade assemblies.

In another example of any of the foregoing assemblies, the seals are blade platform seals.

In another example of any of the foregoing assemblies, the seals contact platforms of the components to limit movement of the damping device away from the axis.

In another example of any of the foregoing assemblies, movement of each of the damping device toward the axis is limited, exclusively, by the first extension and the second extension when the damping device is in an installed position.

A method of damping and sealing a component array according to yet another exemplary aspect of the present disclosure includes, among other things, using a first side of a damping device to engage an extension from a component and a second side of the damping device to engage a seal, reorienting the seal, and using the first side of a damping device to engage the seal and the second side of the damping device to engage the extension.

In another example of the foregoing method, limiting radially outward movement of the damping device suing the seal, and limiting radially inward movement of damping device using extension.

In another example of any of the foregoing methods, the damping device receives the extension within a recess to engage the extension.

In another example of any of the foregoing methods, the damping device receives the seal within a recess to engage the seal.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
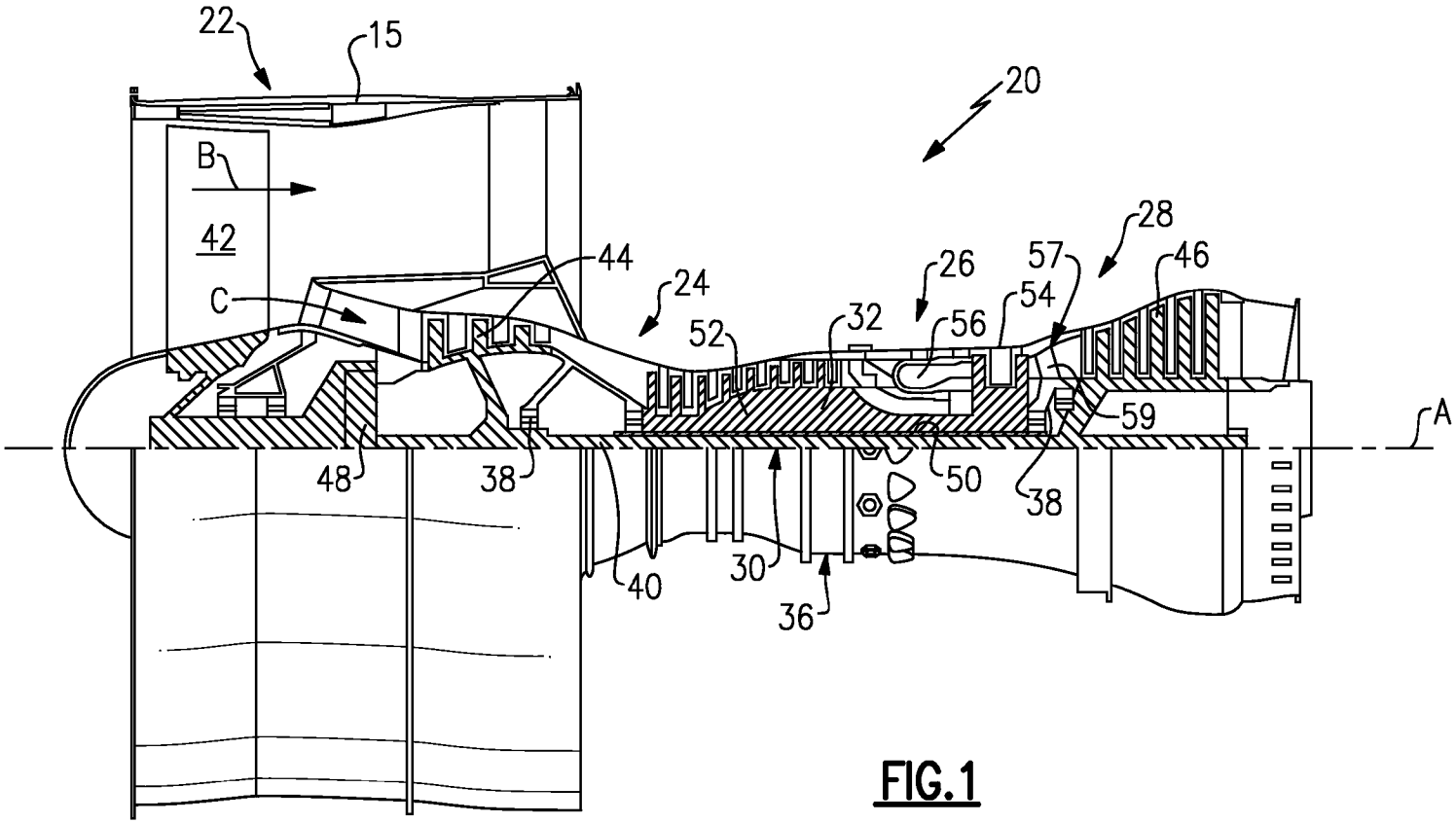
FIG. 1 illustrates an example gas turbine engine having blades that are damped.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28.

The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, the examples herein are not limited to use with two-spool turbofans and may be applied to other types of turbomachinery, including direct drive engine architectures, three-spool engine architectures, and ground-based turbines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48, to drive the fan 42 at a lower speed than the low speed spool 30.

The high speed spool 32 includes an outer shaft 50 that interconnects a second (or high) pressure compressor 52 and a second (or high) pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports the bearing systems 38 in the turbine section 28. The inner shaft 40 and the outer shaft 50 are concentric and rotate via bearing systems 38 about the engine central longitudinal axis A, which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines, including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

Figure 2:
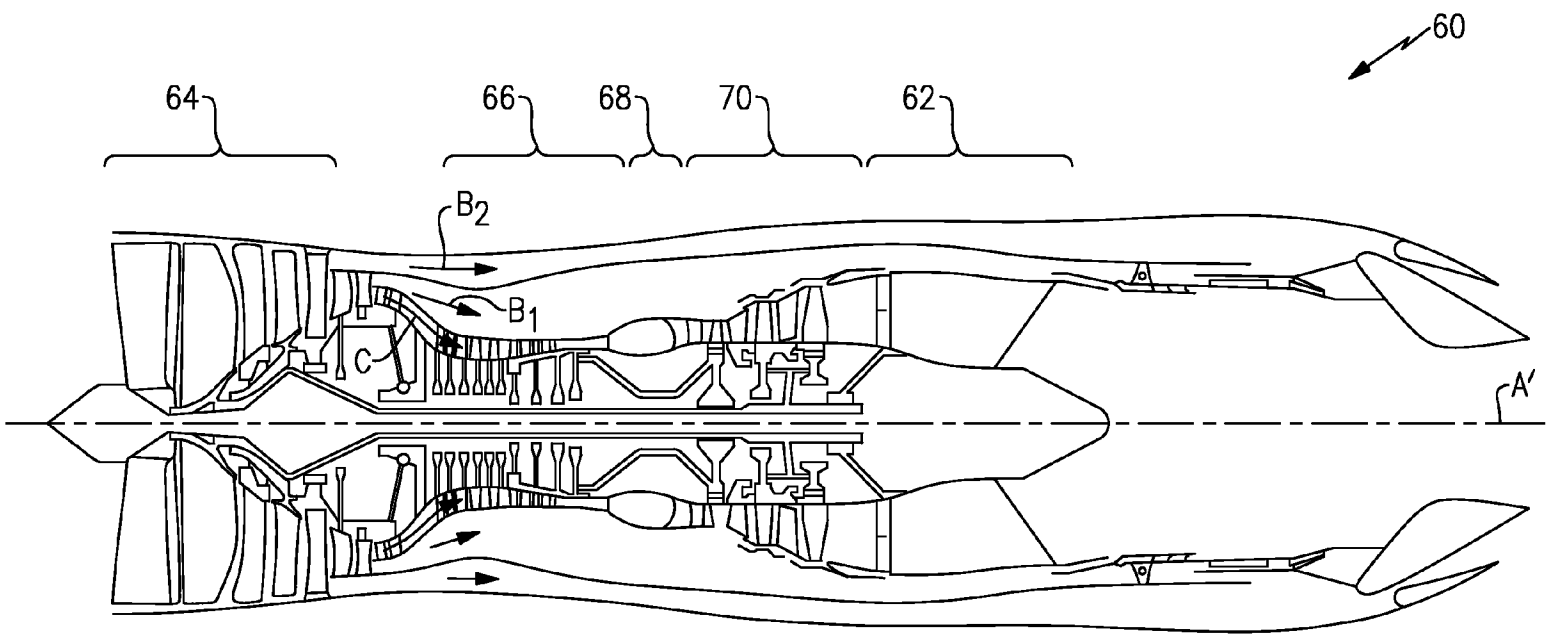
FIG. 2 illustrates another example gas turbine engine having blades that are damped.

Referring now to FIG. 2, another example gas turbine engine 60 includes an augmentor section 62. The engine 60 further includes a fan section 64, a compression section 66, a combustor section 68, and a turbine section 70. Notably, the engine 60 includes a core flow path C, a first bypass flow path $B_1$, and a second bypass flow path $B_2$.

The engine 60 is disposed about an axis A' and operates in a similar fashion to the engine 20 of FIG. 1. The engine 20 and the engine 60 both include multiple arrays of components such as vanes and blades.

Figure 3:
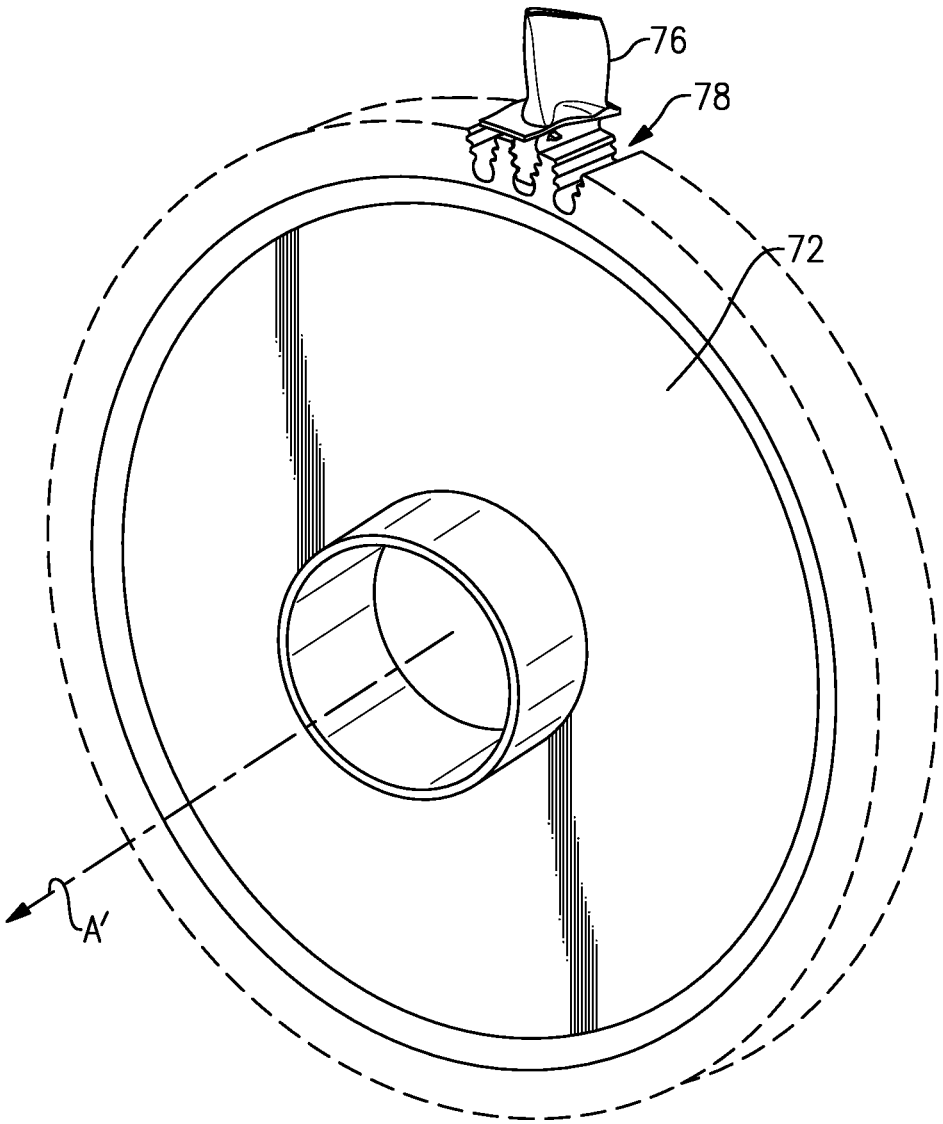
FIG. 3 illustrates a front perspective view of a turbine rotor assembly from the engine of FIG. 2 having a single turbine blade mounted thereto.

Referring now to FIG. 3, with continuing reference to FIG. 2, the turbine section 70 of the engine 60 includes a turbine rotor 72. The rotor 72 includes a plurality of slots 78 distributed annularly about the axis A'. FIG. 3 shows, for clarity, one blade 76 within one of the slots 78. In operation, the rotor 72 would include other blades associated with the other slots 78 of the rotor 72.

Referring now to FIGS. 4 to 10, the example blade 76 includes a root 80, a platform 82, and an airfoil 84 extending from the platform 82 to a tip 86. The root 80 includes dovetail or fir-tree features to engage corresponding features of the respective slot 78 within the rotor 72. The root 80 is slidably received within the slot 78.

Figure 4:
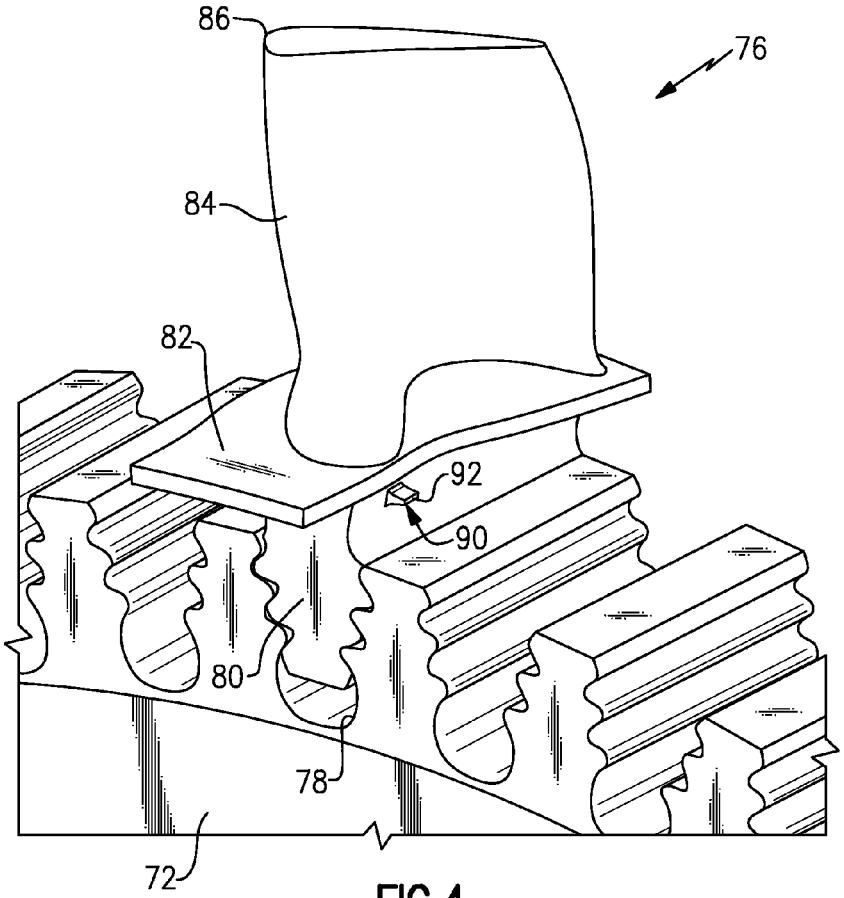
FIG. 4 illustrates a close-up view of the turbine blade of FIG. 3 mounted within the turbine rotor assembly.
Figure 4A:
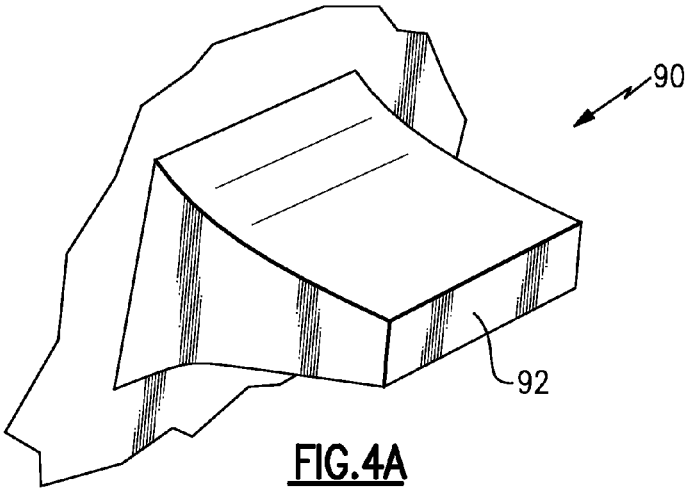
FIG. 4*a* illustrates a close-up view of an extension from a root of the turbine blade of FIG. 4.
Figure 5:
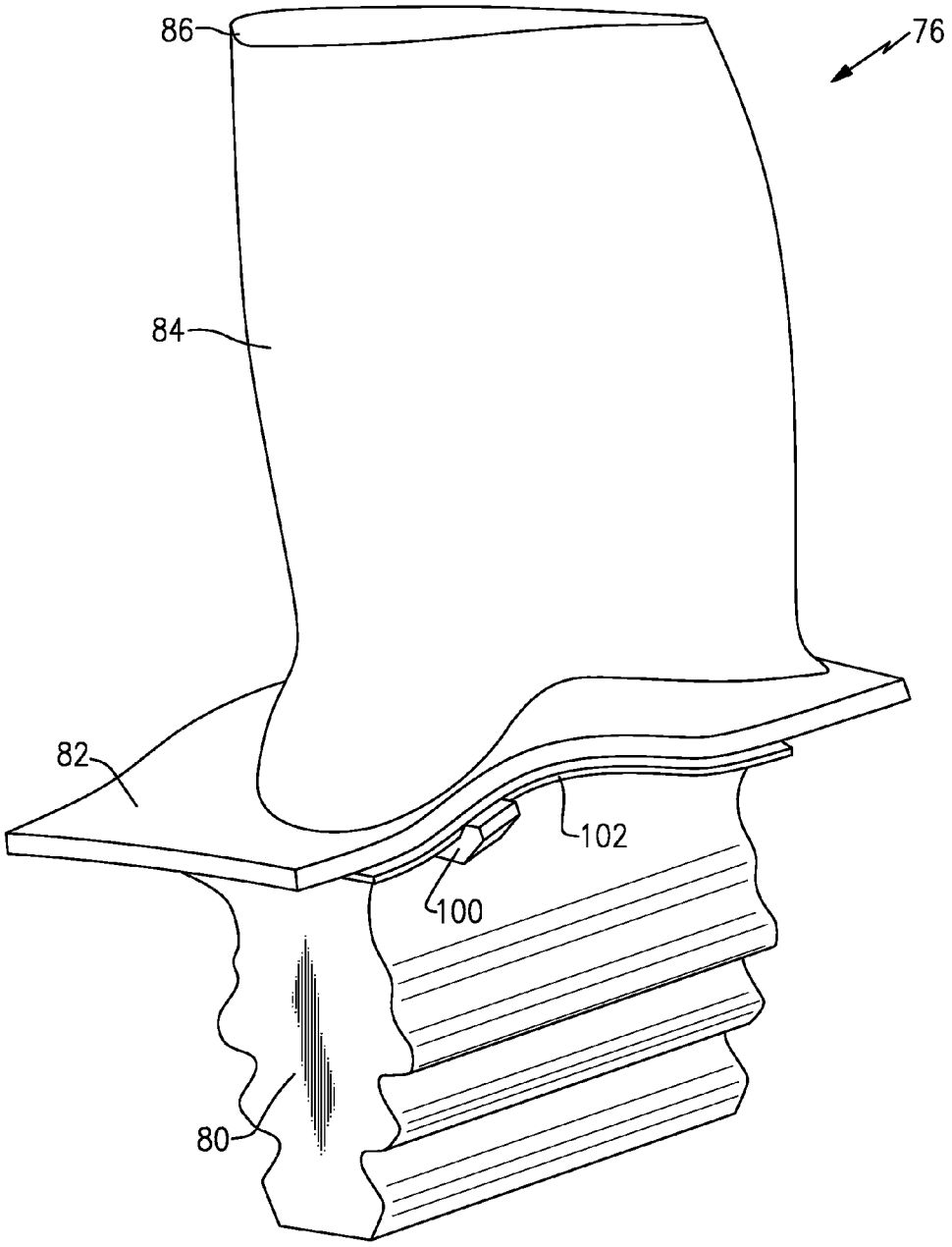
FIG. 5 illustrates the turbine blade of FIG. 4 supporting an example damping device that supports a seal.
Figure 6:
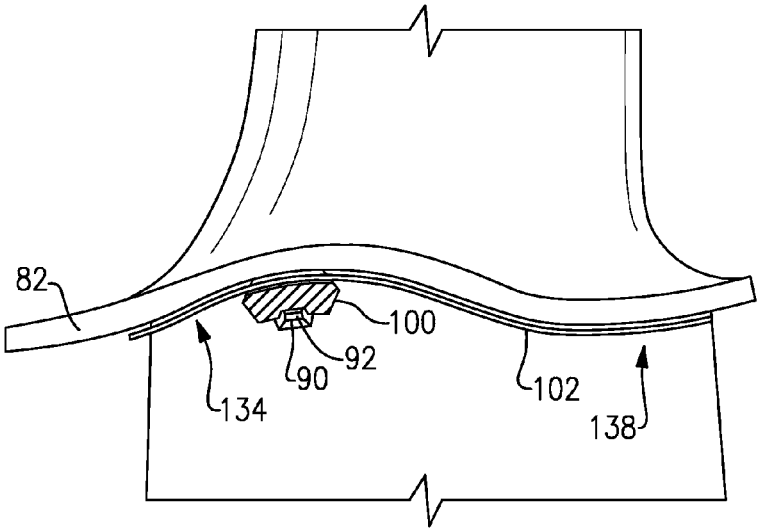
FIG. 6 illustrates a side view of selected portions of the turbine blade of FIG. 5 with portions of the damping device cut away to show the seal.
Figure 7:
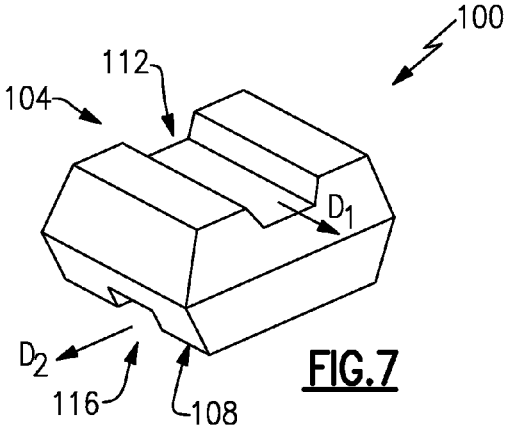
FIG. 7 illustrates a perspective view of the damping device from FIGS. 5 and 6.

The example blade 76 includes an extension 90 extending circumferentially from the root 80 at a position radially outside an outer perimeter of the rotor 72. Another extension (not shown) extends circumferentially from an opposite side of the root 80. The other extension is at the same axial location. In some examples, the other extension directly opposes extension 90. The extension 90 is a post in this example that tapers from the root 80 to a face 92 (FIG. 4A).

The extension 90 engages a damping device 100, which holds a seal 102. The extension 90 supports the damping device 100 when engaging the damping device 100. The seal 102 is a blade platform seal in this example.

During operation, the damping device 100 is positioned circumferentially between the blade 76 and a circumferentially adjacent blade 76*a*. The damping device 100 absorbs vibrational energy from the blade 76 and the circumferentially adjacent blade assembly by engaging in frictional sliding between adjacent blades. Absorbing the vibrational energy can inhibit fatigue. The damping device 100 can be positioned axially at a point of the blade 76 found to have the highest level of displacement during operation. Placement at the point of highest vibratory displacement can result in more effective damping. The location of maximum displacement during vibration can be at the aft end, the forward end, or somewhere in between depending on the vibratory mode shape.

The example damping device 100 includes a first side 104 and a second side 108 facing away from the first side 104. When the damping device 100 is in an installed position, the first side 104 can face radially inward or radially outward.

The first side 104 includes a first recessed area 112. The second side 108 includes a second recessed area 116. A cross-sectional profile of the first recessed area 112 mimics the cross-sectional profile of the second recessed area 116. In this example, the first recessed area 112 is substantially identical to the second recessed area 116.

The first recessed area 112 extends longitudinally in a direction $D_1$. The second recessed area 116 extends longitudinally in a second direction $D_2$. The direction $D_1$ is transverse to the direction $D_2$. In some examples, the direction $D_1$ is offset from 65 to 80 degrees from the direction $D_2$. In other examples, the direction $D_1$ is substantially perpendicular to the direction $D_2$.

Damping device 100 includes a first portion 120 and a second portion 121. In this example, the portions 120 and 121 have the same geometry. The damping device 100 presents substantially the same surfaces when in a first position and when in a second position that is rotated 180 degrees about axis Da from the first position.

The damping device 100 presents substantially the same surfaces when in a third position and when in a fourth position that is rotated 180 degrees about an axis that stretches from one corner $C_1$ to an opposite corner $C_2$. These two rotational transformations create four unique orientations in which the damping device is identical to itself. The corners $C_1$ and $C_2$ are angled at less than ninety degrees in this example. In another example, the corners $C_1$ and $C_2$ are ninety degrees such that the profile of the damping device 100 is square.

In this example, the second recessed area 116 receives the extension 90 when the damping device 100 is installed. The first recessed area 112 receives a seal 102.

In another example, the first recessed area 112 could receive the extension 90 and the second recessed area 116 could receive the seal 102. The damping device 100 can also be rotated 180 degrees about the damping device axis $D_a$ and still be in a position appropriate for installation.

Configuring the first recessed area 112 and the second recessed area 116 to both be able to receive the extension 90 or the seal 102 simplifies installation. The damping device 100 can be installed so that the first side 104 is facing radially outward or radially inward.

Figure 8:
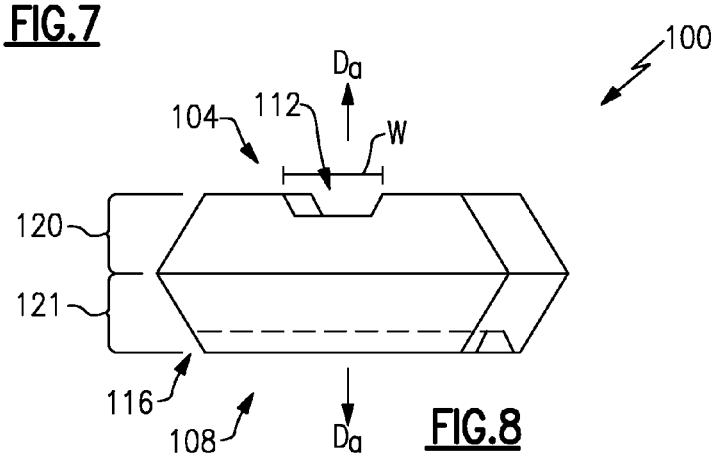
FIG. 8 illustrates a side view of the damping device of FIG. 7.
Figure 10:
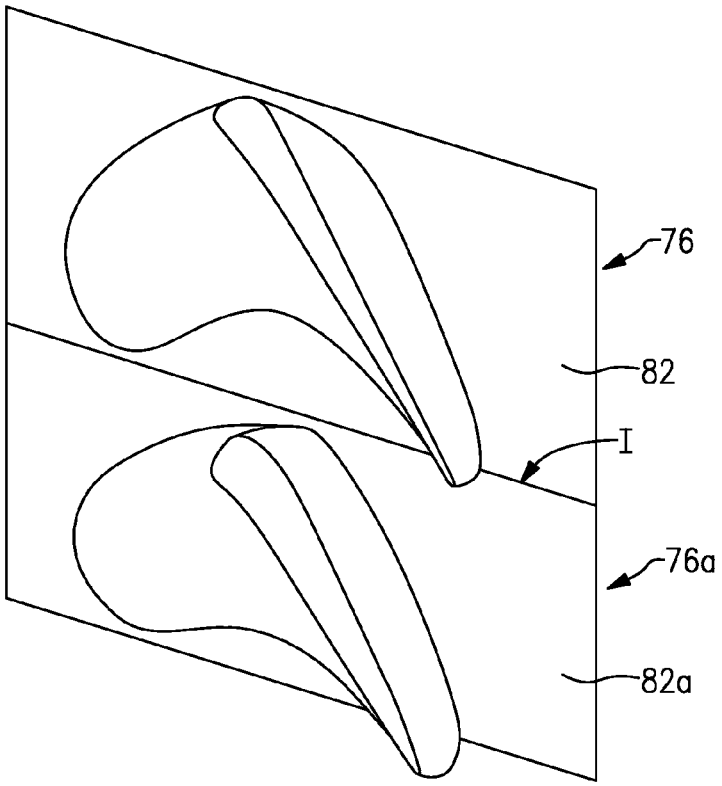
FIG. 10 illustrates the turbine blade of FIG. 4 interfacing with a circumferentially adjacent blade.
Figure 11:
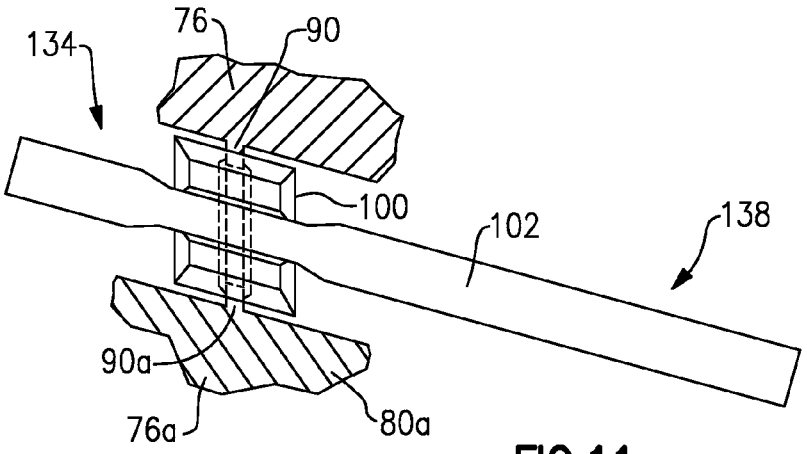
FIG. 11 illustrates FIG. 9 with selected portions of the turbine blades cutaway to show the damping device holding the seal.

The seal 102 is supported by the damping device 100. The seal 102 includes a leading portion 134 upstream from the damping device 100 and a trailing portion 138 downstream from the damping device 100 (FIG. 8). The leading portion 134 and the trailing portion 138 are circumferentially enlarged relative to a width W of the first recessed area 112 (FIG. 10). Circumferentially enlarging the seal 102 at these locations ensures that the seal 102 will maintain its axial position within the first recessed area 112. The circumferential enlarged areas limit axial movement of the seal 102 relative to the damping device 100 when the seal 102 is within the first recessed area 112 or the second recessed area 116.

In another example, only one of the leading portion 134 or the trailing portion 138 is circumferentially enlarged. In yet another example, the circumferential width of the seal 102 is consistent along the entire axial length of the seal 102.

Figure 9:
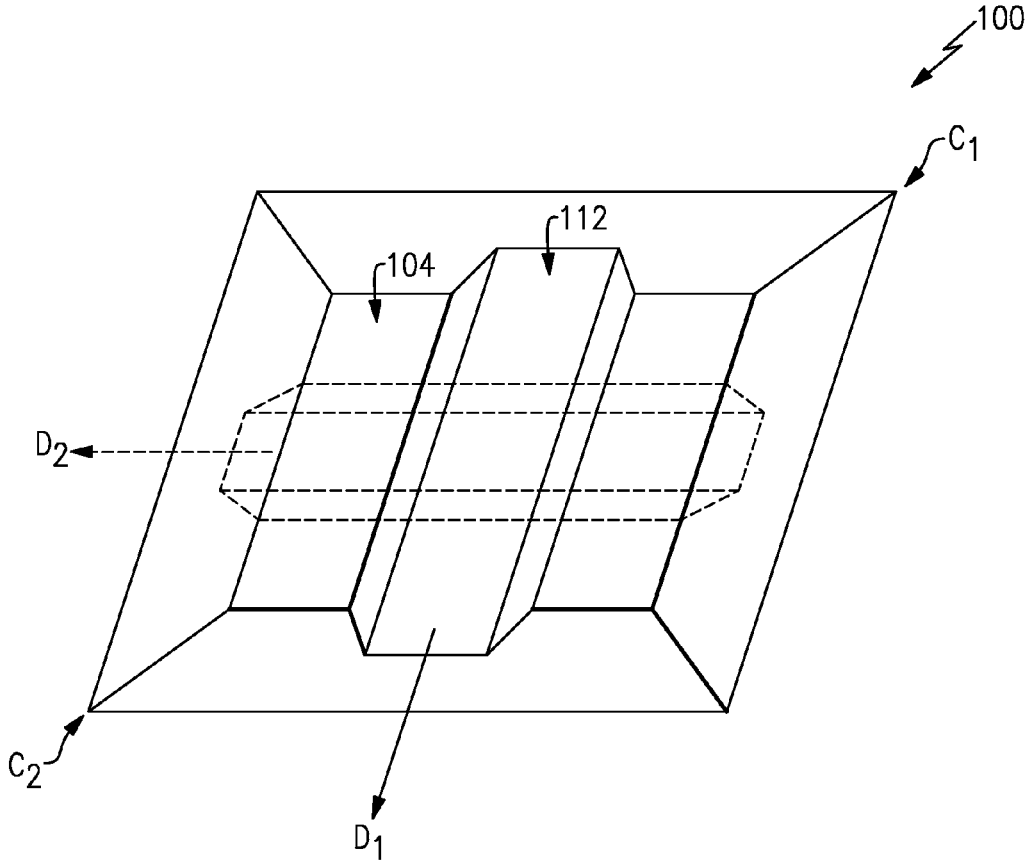
FIG. 9 shows a top view of the damping device of FIG. 7.

When the blade 76 is in an installed position next to the circumferentially adjacent blade 76*a*, the platform 82 interfaces with a platform 82*a* of the blade 76*a* at an interface I (FIG. 9). During operation, circumferential forces due to the rotating rotor 72 force the seal 102 radially outward against the platform 82, which seals the interface I. During operation, the seal 102 moves against the undersides of the platforms 82 and 82*a* to seal the interface I.

In some examples, when the damping device 100 is installed, the first recessed area 112 is perpendicular to the engine axis A', and the second recessed area 116 is parallel to the interface I.

The example seal 102 is manufactured from sheet metal or another metallic material. The seal 102 may be from 0.008"-0.025" thick in some examples.

In this example, radially inward movement of the damping device 100 is limited, exclusively, by the extension 90 and an extension 90*a* from a root 80*a* of the blade 76*a* (FIG. 10). Notably, only two extensions 90 and 90*a* are required to support the damping device 100.

The example damping device 100 is a cast cobalt alloy. In another example, the damping device 100 could be nickel. The damping device 100 could also be manufactured by an additive manufacturing process in another example.

The example damping device 100 is described in connection with a blade from the turbine section 70 of the engine 60. The example damping device 100 could be used in connection with blades from other areas of the engine 60 or the engine 20, such as the compression sections 24 and 66.

Features of some of the disclosed examples include a damping device that can be installed in multiple positions. The damping device can accommodate a seal in a first position. The damping device can be flipped and rotated ninety degrees to accommodate the same seal in a second position. The damping device can also be rotated 180 degrees from an installation position to another installation position. The damping device has, in these examples, four potential installation positions, which can reduce potential for installation errors associated with installing the damping device.

Alternative engine designs can include an augmentor section (not shown) among other systems or features.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

I claim:

1. A gas turbine engine assembly, comprising:

a damping device having a first side and a second side facing away from the first side, the first side configured to hold a seal within a first recessed area when the second side engages an extension from a gas turbine engine component within a second recessed area, the first side further configured to engage the extension within the first recessed area when the second side holds the seal within the second recessed area, wherein a first axis extends from the first side to the second side, wherein the damping device is configured to flip about a second axis transverse to the first axis and rotate a quarter-turn about the first axis to a position where the damping device instead holds the seal within the second recessed area while holding the extension within the first recessed area.

2. The gas turbine engine assembly of claim 1, wherein the first recessed area extends longitudinally in a first direction, and the second recessed area extends longitudinally in a second direction perpendicular to the first direction.

3. The gas turbine engine assembly of claim 1, wherein the first recessed area has a cross-sectional profile that mimics a cross-sectional profile of the second recessed area.

4. The gas turbine engine assembly of claim 1, wherein the gas turbine engine component is a blade and the extension is a first extension from a root of a first blade, and the first recessed area is further configured to engage a second extension from a root of a second blade when the second side engages the seal.

5. The gas turbine engine assembly of claim 4, wherein radially inward movement of the damping device is limited exclusively by the first extension and the second extension.

6. The gas turbine engine assembly of claim 1, wherein the damping device is configured to be positioned circumferentially between a first blade and a second blade.

7. The gas turbine engine assembly of claim 6, wherein the first blade and the second blade are constituents of a turbine blade array.

8. The gas turbine engine assembly of claim 1, wherein the damping device is a cast component.

9. A gas turbine assembly, comprising:

a plurality of components circumferentially distributed about an axis;

a plurality of seals; and a damping device having a first side and a second side opposite the first side, the first side engaging one of the seals within a first recessed area, the second side engaging a first extension from a first one of the components and further engaging a second extension from a second one of the components within a second recessed area, wherein the damping device is configured to be reoriented by rotating the damping device a quarter-turn about a first axis and flipping the damping device a half-turn about a second axis that is transverse to the first axis such that the first side engages the first and second extensions within the first recessed area as the second side engages the one of the seals within the second recessed area.

10. The gas turbine assembly of claim 9, wherein the components are blades and the first extension extends from a root of one of the blades, and the second extension extends from a root of the second one of the blades.

11. The gas turbine assembly of claim 9, wherein the plurality of components are turbine blade assemblies.

12. The gas turbine assembly of claim 9, wherein the seals are blade platform seals.

13. The gas turbine assembly of claim 9, wherein the seals contact platforms of the components to limit movement of the damping device away from the axis.

14. The gas turbine assembly of claim 9, wherein movement of the damping device toward the axis is limited, exclusively, by the first extension and the second extension when the damping device is in an installed position.

15. A method of damping and sealing a component array, comprising:

using a first recessed area within a first side of a damping device to engage an extension from a component while a second recessed area within a second side of the damping device engages a seal;

reorienting the damping device by rotating the damping device a quarter-turn about a first axis and flipping the damping device a half-turn about a second axis that is transverse to the first axis; and using the first recessed area within the first side of the damping device to engage the seal and while the second recessed area within the second side of the damping device engages the extension.

16. The method of claim 15, further comprising limiting radially outward movement of the damping device using the seal, and limiting radially inward movement of damping device using extension.

17. The method of claim 15, wherein the damping device receives the extension within the first recessed area to engage the extension.

18. The method of claim 15, wherein the damping device receives the seal within the second recessed area to engage the seal.

* * * * *